US005623276A

United States Patent [19]

Moore et al.

[11] Patent Number: 5,623,276

[45] Date of Patent: Apr. 22, 1997

[54] KICKER PULSE CIRCUIT FOR AN ADDRESSING STRUCTURE USING AN IONIZABLE GASEOUS MEDIUM

[75] Inventors: John S. Moore; Kevin J. Ilcisin, both of Beaverton, Oreg.

[73] Assignee: Tektronix, Inc., Wilsonville, Oreg.

[21] Appl. No.: 293,107

[22] Filed: Aug. 19, 1994

Related U.S. Application Data

[63] Continuation of Ser. No. 26,366, Mar. 4, 1993, abandoned.

[51] Int. Cl.[6] ..... G09G 3/28

[52] U.S. Cl. ..... 345/60; 345/84; 345/87

[58] Field of Search ..... 345/60, 61, 63, 345/64, 66, 67, 68, 84, 86, 87; 315/169.4

[56] References Cited

U.S. PATENT DOCUMENTS

| | | | |
|---|---|---|---|
| 3,262,010 | 7/1966 | Kazan | 315/63 |
| 3,812,486 | 5/1974 | Purchase | 340/324 M |
| 3,955,187 | 5/1976 | Bigelow | 340/324 M |
| 4,030,091 | 6/1977 | Ngo | 340/771 |
| 4,044,349 | 8/1977 | Andoh et al. | 340/775 |
| 4,117,472 | 9/1978 | Freer et al. | 340/324 M |
| 4,140,945 | 2/1979 | Trogdon | 340/776 |
| 4,319,239 | 3/1982 | Stephens | 340/784 |
| 4,322,659 | 3/1982 | De Jule et al. | 315/169.1 |

(List continued on next page.)

FOREIGN PATENT DOCUMENTS 0251230 1/1988 European Pat. Off. .

OTHER PUBLICATIONS

Howard et al., "Eliminating Crosstalk in Thin Film Transistor/Liquid Crystal Displays," *International Display Research Conference,* 230–35, 1988.

Powell et al., "A 6–in. Full Color Liquid Crystal Television Using an Active Matrix of Amorphous–Silicon TFTs," *Proceedings of the SID,* 227–232, vol. 29/3 1988.

Mikoshiba, Shigeo, "Plasma Displays," Seminar 10, SID 1987, 10.2–10.37.

Firester, Arthur H., "Active Matrices for Liquid–Crystal Displays," Seminar 5, SID 1987, 5.2–5.25.

Scheffer, Terry J., "Direct–Multiplexed Liquid–Crystal Displays," Seminar 4, SID 1987, 4.2–4.34.

Howard, W.E., "Active–Matrix Techniques for Displays," Proceedings of the SID, vol. 27/4, 313–326.

Dick, George W., "Plasma Display Panel Techniques," Seminar 2, SID 1985 2.2–1—2.2.–54.

Matsumoto et al., "4.1 Voltage Averaging Driving Method," *The Newest Technology of Liquid Crystal,* Kogyo Chosakai Co., 106, 1983.

*Primary Examiner*—Steven Saras

*Attorney, Agent, or Firm*—James W. Jandacek; Paul S. Angello; John D. Winkelman

[57] ABSTRACT

An addressing structure (10, 10') using an ionizable gaseous medium has plural nonintersecting channels (20, 20') extending in a first direction and filled with an ionizable gaseous medium. Each channel contains a reference electrode (30, 30') and a row electrode (62, 62'). An amplifier (100) provides a kicker pulse to one or both of the first and second electrodes in a channel at a time coincident with the application of a second electrical signal to the second electrode. The kicker pulse and the second electrical signal cooperate to promote ionization of the gaseous medium within a predetermined discharge initiation delay time tolerance. The ionization captures across a liquid crystal material (44) data signals placed on column electrodes (18); the data signals place display elements (16) associated with the electro-optic material in predetermined data storage or display element states. When data signals are applied to first electrodes (18) extending transversely across a channel and are of a type that does not repeat in immediately successive image fields data signals having the same polarity with respect to the reference electrode, the kicker pulse is applied to some or all channels in some or all image fields.

19 Claims, 8 Drawing Sheets

U.S. PATENT DOCUMENTS

| | | | |
|---|---|---|---|
| 4,352,101 | 9/1982 | De Jule | 340/769 |
| 4,391,492 | 7/1983 | Lu et al. | 350/351 |
| 4,450,441 | 5/1984 | Person et al. | 340/773 |
| 4,485,380 | 11/1984 | Soneda et al. | 340/784 |
| 4,554,537 | 11/1985 | Dick | 340/775 |
| 4,613,854 | 9/1986 | Holz et al. | 340/776 |
| 4,652,087 | 3/1987 | Bos et al. | 350/332 |
| 4,833,463 | 5/1989 | Dick et al. | 315/169.4 |
| 4,845,482 | 7/1989 | Howard et al. | 340/805 |
| 4,892,389 | 1/1990 | Kuijk | 350/333 |
| 4,896,149 | 1/1990 | Buzak et al. | 340/794 |
| 4,924,218 | 5/1990 | Weber et al. | 340/776 |
| 4,945,352 | 7/1990 | Ejiri | 340/805 |
| 5,077,553 | 12/1991 | Buzak | 340/794 |
| 5,361,080 | 11/1994 | Kwon | 345/60 |

FIG. 2
PRIOR ART
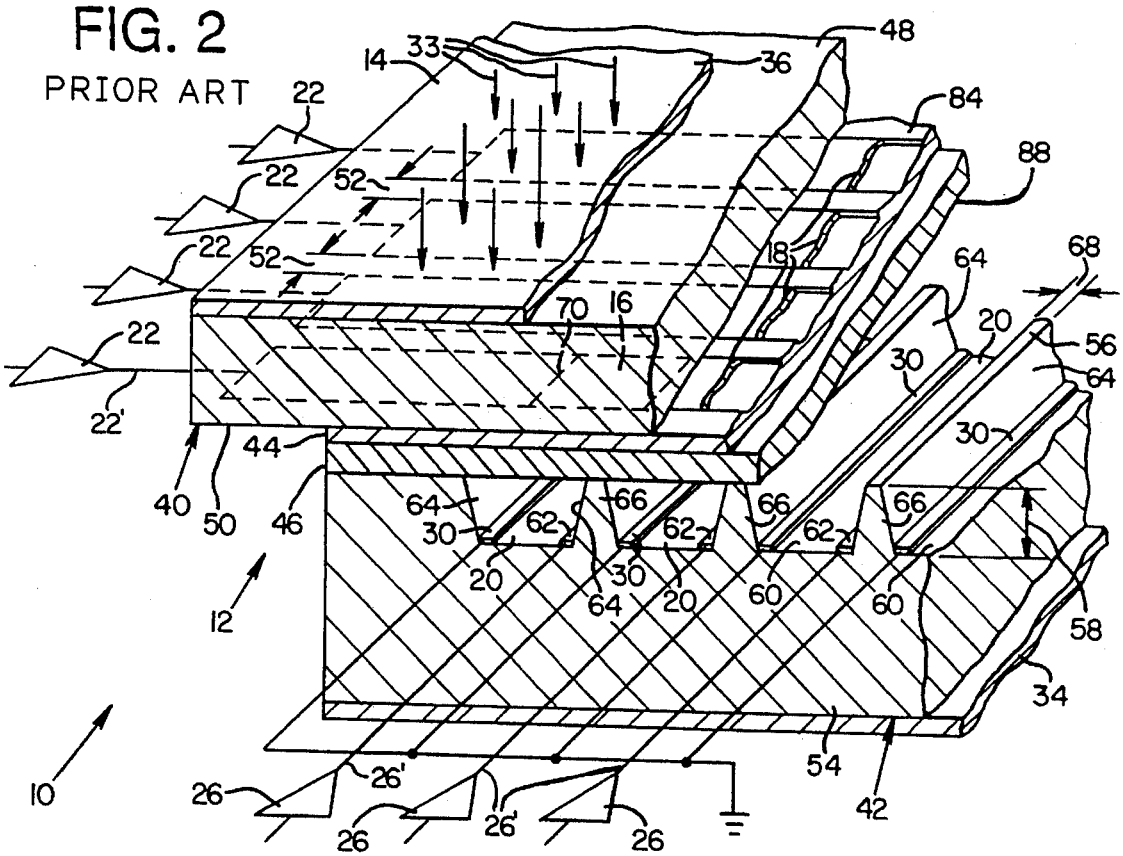
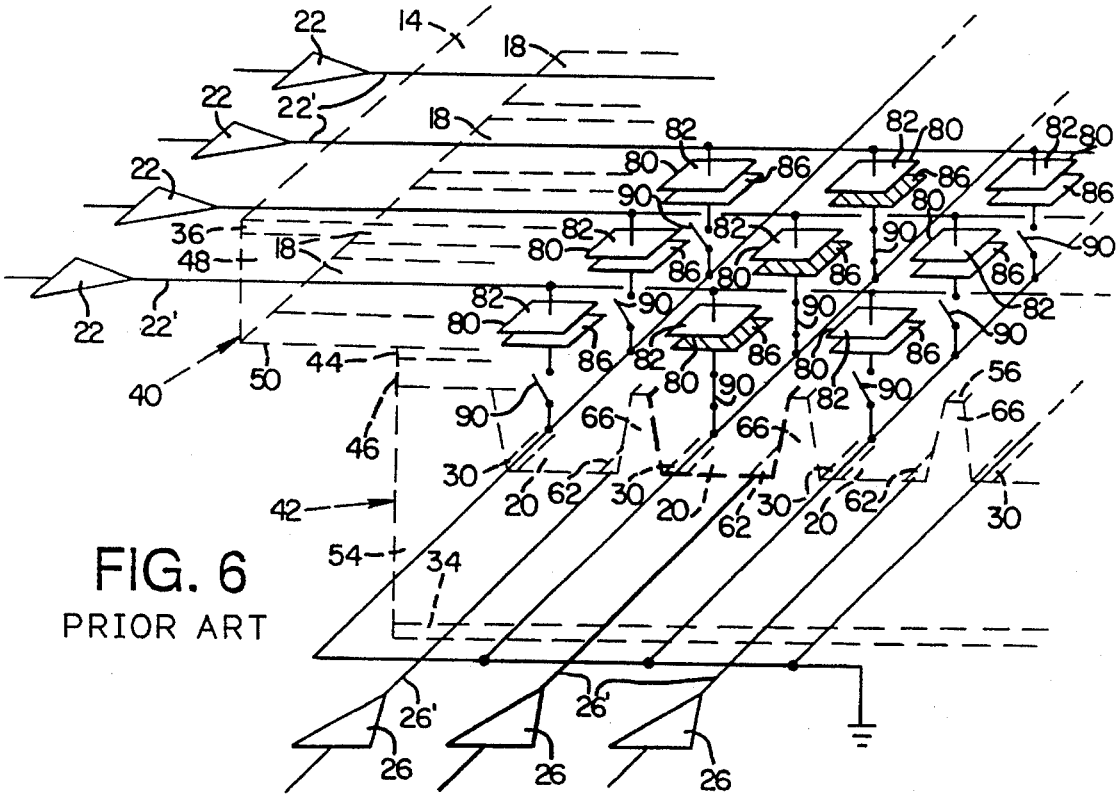
FIG. 6
PRIOR ART

FIG. 9 OFF -- FIELD N AFTER DATA CAPTURE
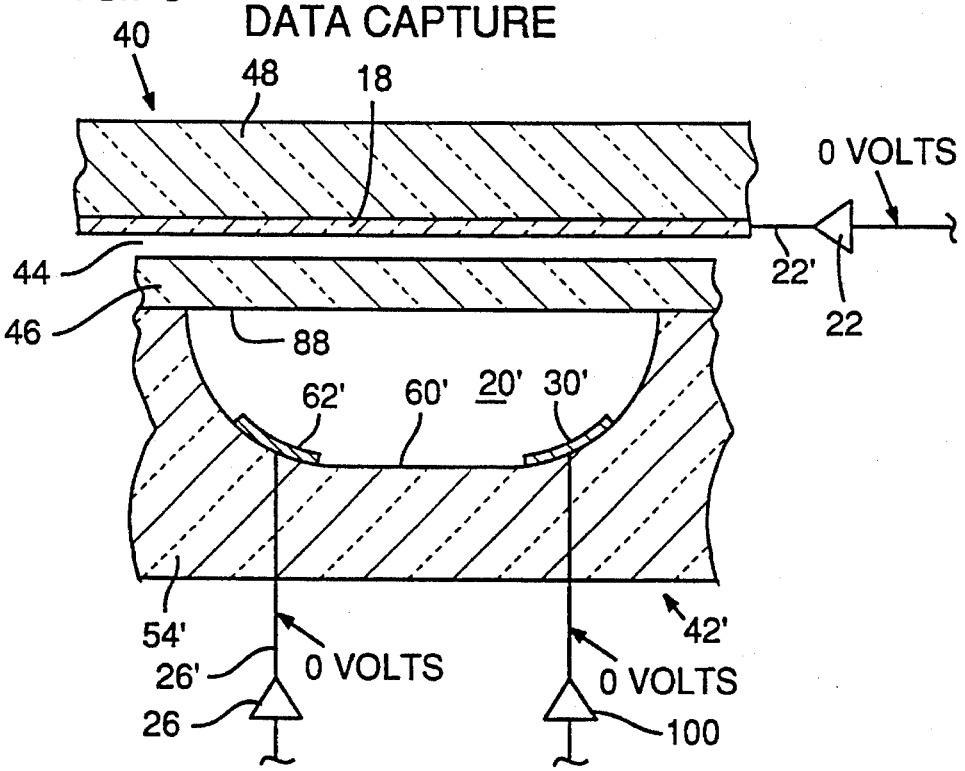
FIG. 10 OFF FOLLOWED BY OFF - - FIELD N + 1 AFTER CATHODE BIAS APPLIED BUT BEFORE PLASMA INITIATION
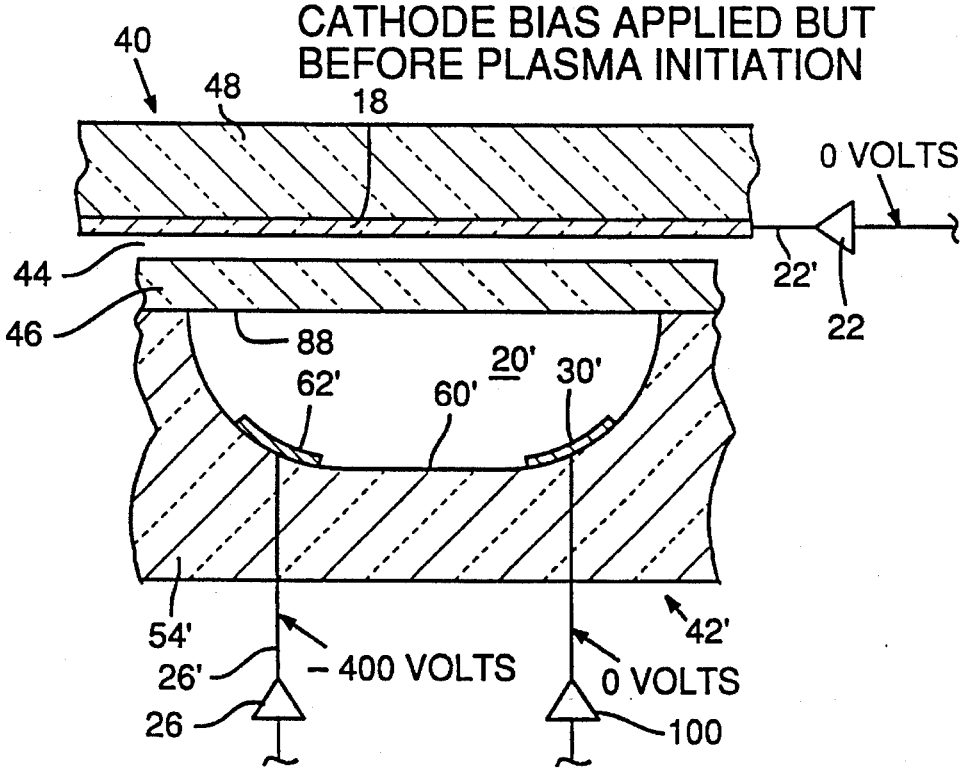

FIG. 11 ON (LOWER) -- FIELD N AFTER DATA CAPTURE
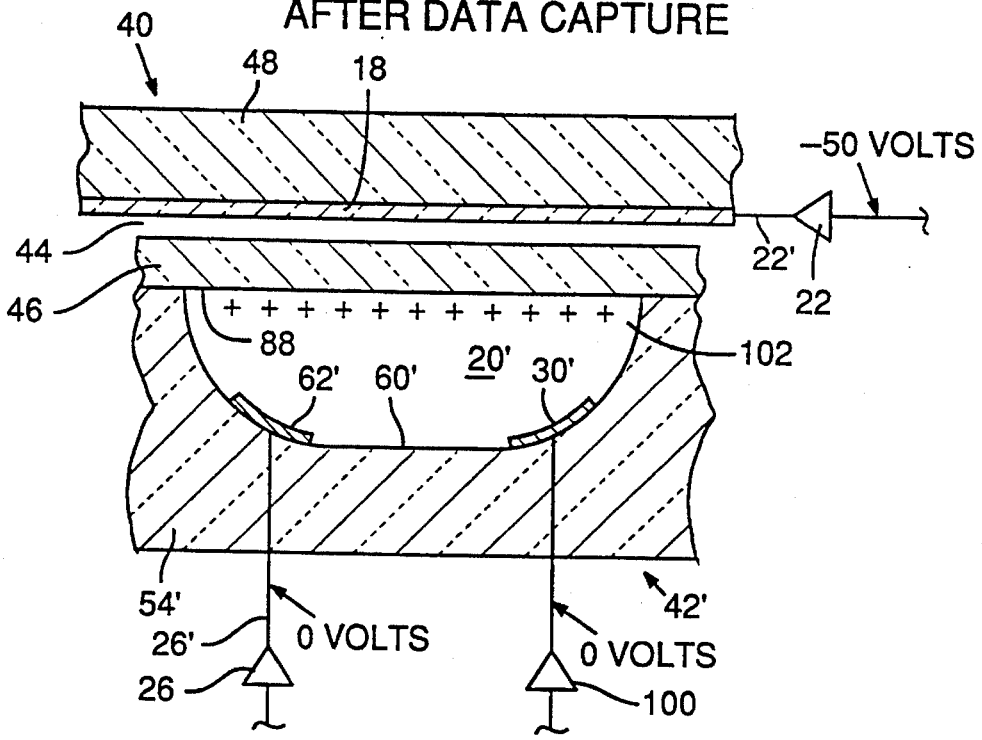
FIG. 12 ON (LOWER) FOLLOWED BY ON (HIGHER) -- FIELD N +1 AFTER CATHODE BIAS APPLIED BUT BEFORE PLASMA INITIATION
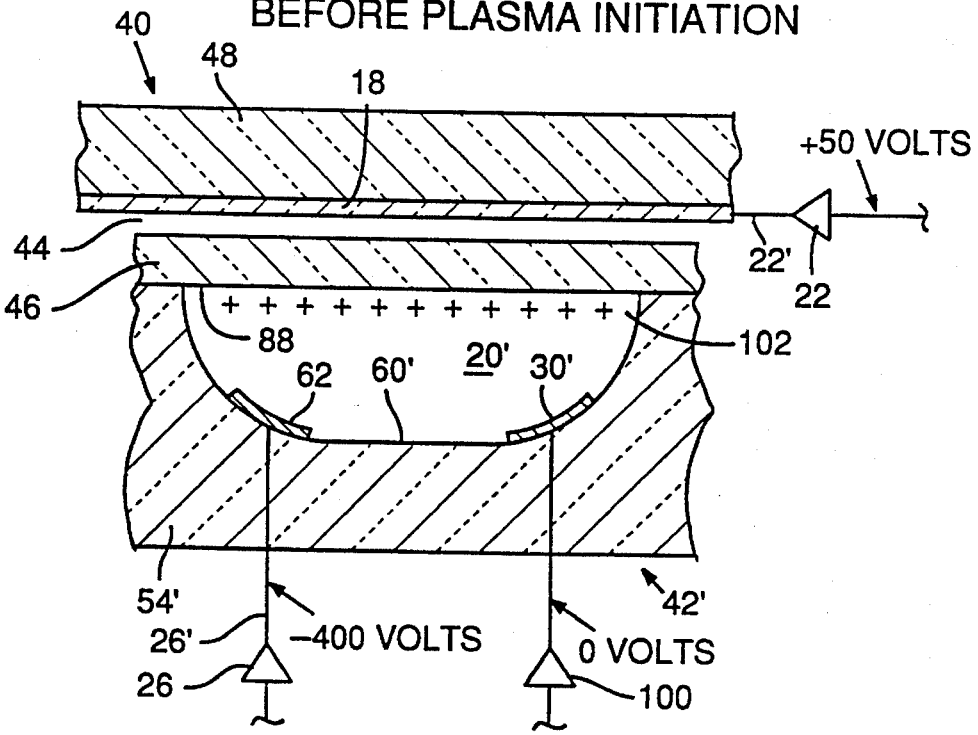

FIG. 13 ON (HIGHER) -- FIELD N AFTER DATA CAPTURE
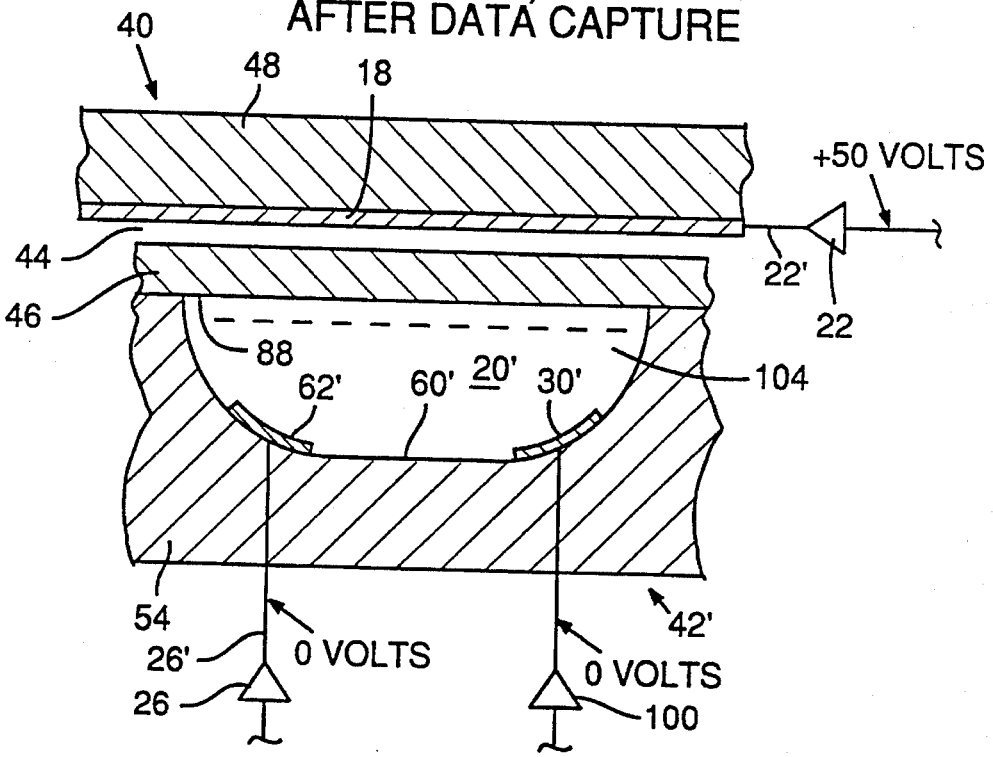
FIG. 14 ON (HIGHER) FOLLOWED BY ON (LOWER) -- FIELD N +1 AFTER CATHODE BIAS AND ANODE PULSE APPLIED BUT BEFORE PLASMA INITIATION
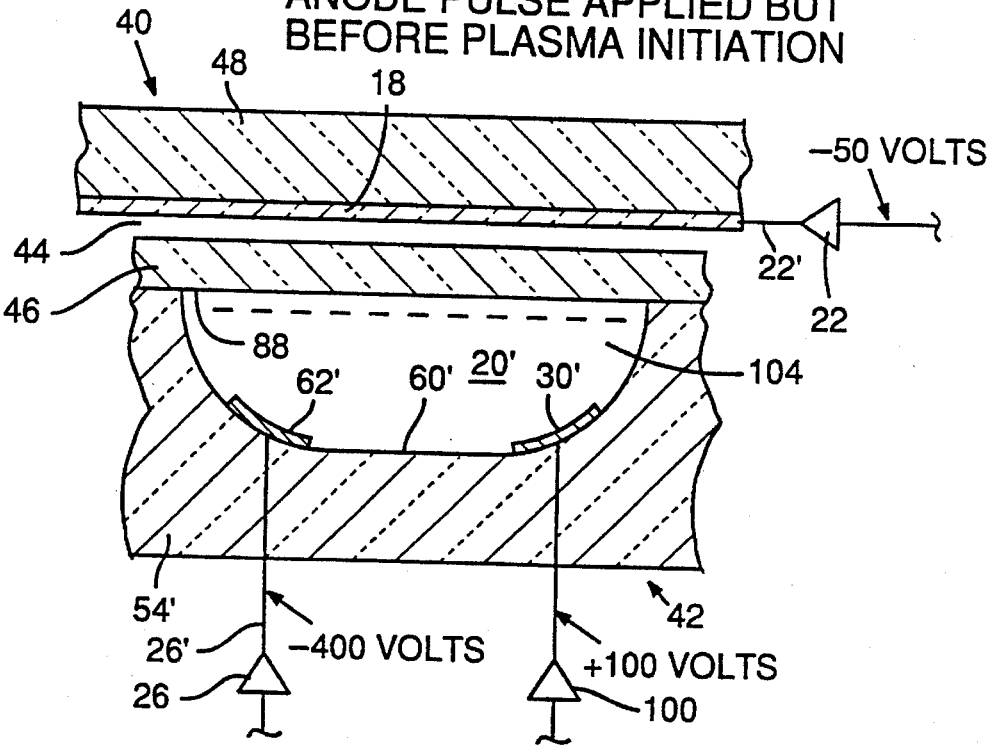

KICKER PULSE CIRCUIT FOR AN ADDRESSING STRUCTURE USING AN IONIZABLE GASEOUS MEDIUM

This is a continuation of application Ser. No. 08/026,366 filed Mar. 4, 1993 which is now abandoned.

TECHNICAL FIELD

The present invention pertains to electrical circuits for stimulating ionization in systems of data storage elements which employ an ionizable gas to address the storage elements.

BACKGROUND OF THE INVENTION

U.S. Pat. No. 4,896,149, issued Jan. 23, 1990, to Buzak et al. ("'149 Patent") and assigned to the assignee of the present application, discloses an addressing structure using an ionizable gaseous medium. Such an addressing structure may be used in a system constructed of data storage elements which addresses those data storage elements with the use of an ionizable gas. An example of such a system is a flat panel display, a video camera, or a memory system.

The system disclosed in the '149 Patent has an electrode structure which defines rows of channels, each of which is filled with an ionizable gas. Extending along the base of each of those channels are a row electrode and a reference electrode. The row electrode is electrically driven as a cathode, and the reference electrode is referenced to ground and acts as an anode when the row electrode is electrically driven as a cathode. When a particular row electrode is driven as a cathode, the ionizable gas in the particular channel which contains that row electrode is ionized. Some of the gas atoms are ionized, some are merely excited but not ionized, and the system operates as disclosed in the '149 Patent.

One embodiment of the system disclosed in the '149 Patent is a flat panel display system in which the electric field across an electro-optic material is changed in response to data signals provided over column electrodes. For certain electro-optic materials (for example, liquid crystals) it is necessary to ensure that no long term net DC electric field is applied to the materials; if such a field is applied, the material loses its desired electro-optical properties, or other undesired effects (such as dissociation of a liquid crystal material) can occur. In a flat panel display system this is preferably accomplished by alternating the polarity in immediately succeeding image fields of the data signals applied to the data storage elements ("pixels").

In operating a flat panel display of this type it often happens that pixels do not display the image they are supposed to display. Some such problems are caused by a variety of different cross-talk effects which (together with solutions for mitigating them) are described in U.S. patent application Ser. No. 07/854,145, filed Mar. 19, 1992, for REDUCING CROSS TALK EFFECTS IN ELECTRO-OPTICAL ADDRESSING STRUCTURES, U.S. patent application Ser. No. 07/958,631 for an ADAPTIVE DRIVE WAVEFORM FOR REDUCING CROSSTALK EFFECTS IN ELECTRO-OPTICAL ADDRESSING STRUCTURES, filed Oct. 9, 1992, U.S. Pat. No. 5,414,44 for an ELECTRO-OPTICAL ADDRESSING STRUCTURE HAVING REDUCED SENSITIVITY TO CROSS-TALK, and U.S. Pat. No. 5,400,046 for an ELECTRODE SHUNT IN PLASMA CHANNEL. Each of those applications and patents is assigned to the assignee of the present application.

However, pixels of a flat panel display of the type described in the '149 Patent may also fail to display the image they are supposed to display because pixels in an apparently unpredictable way fail to activate at the proper time or even fail to activate at all. This problem can cause the flat panel display to create an image with incorrect shade or color, inadequate resolution, or annoying flicker.

There is accordingly a need to reduce or eliminate the problem of failure to activate pixels during the operation of a flat panel display using an addressing structure of the type described in the '149 Patent.

SUMMARY OF THE INVENTION

An object of the present invention is, therefore, to eliminate from a flat panel display using an addressing structure of the type disclosed in the '149 Patent late firing or nonfiring of the ionizable gaseous medium associated with a data storage element (pixel) with consequent failure of the pixel properly to reflect an applied data signal.

The invention solves the problem noted above and meets the foregoing technical objective by providing an improved addressing structure of the type disclosed in the '149 Patent. To the structure and electrical drive system disclosed in the '149 Patent are added a means (for example, an amplifier) for providing a third electrical signal or kicker pulse to one or both of the reference and row electrodes within a channel. The kicker pulse is provided coincident with provision of a second electrical signal or ionizing signal and cooperates with the ionizing signal to ensure that the gaseous medium is ionized within a predetermined discharge initiation delay time tolerance. The amplifier holds the reference electrode at a nominal electrical potential that serves as a reference potential for the other electrodes except during times the amplifier is providing the kicker pulse to the reference electrode.

There are many options for implementing an improved addressing structure in accordance with the invention. The kicker pulse may be, and preferably is, of a character that increases the difference in electrical potential between the row electrode and the reference electrode in a channel. The kicker pulse may also be, and preferably is, of a character that does not substantially change the response of the electro-optic material to data and ionization signals during a predetermined data capture time. Where the electro-optic material is of the RMS-responding type (for example, a liquid crystal material), the kicker pulse may be, and preferably is, of a character insufficient to affect substantially the RMS field applied to the electro-optic material during a succession of image fields. In different implementations the kicker pulse is applied to the reference electrode, the row electrode, or both of them.

An addressing structure in accordance with the invention also may provide one of a wide spectrum of alterative conditions for providing the kicker pulse to one or all of the channels. To produce a condition where no long term net DC electric field is applied to the electro-optic material, first electrical signals or data signals on column electrodes provide one of an OFF storage element state (corresponding, for example, to a lightest pixel in a flat panel display) and a preselected ON storage element state (corresponding, for example, in a flat panel display to a darkest pixel, a pixel of predetermined gray scale value, or a pixel of predetermined color intensity).

The first electrical signals include an OFF signal, an ON signal of higher potential, and an ON signal of lower potential. The ON signal of higher potential places first electrodes at a potential higher than the nominal electrical potential, and the ON signal of lower potential places first electrodes at a potential lower than the nominal electrical potential. For each preselected ON storage element state, the ON signals of higher and lower potential are preferably the same signal waveform (e.g., a square wave of constant amplitude such as 50 volts) but with polarity reversed with respect to the nominal electrical potential. The ON signals of higher and lower potential for each preselected ON state place a pixel in the same desired display condition (e.g., data signals that are one of 50 volts higher than and 50 volts lower than the nominal reference potential each correspond to the same black display condition of a pixel); another pair of ON signals of higher and lower potential places a pixel in another desired display condition (e.g., data signals that are one of 25 volts higher than and 25 volts lower than the nominal reference potential each correspond to the same gray scale display condition of a pixel).

Data signals producing an ON storage element state are provided in successive image fields in such a way that ON signals of higher potential are not provided in two immediately succeeding image fields, and ON signals of lower potential are not provided in two immediately succeeding image fields. As an example, data signals are provided in alternate image fields as one of (a) one of the ON signal of higher potential and the OFF signal and (b) one of the ON signal of lower potential and the OFF signal.

With such data signals the kicker pulse may be delivered in a spectrum of conditions including applying the kicker pulse only in a channel where conditions most favor delayed or missed firing below a pixel to applying the kicker pulse to each channel in each image field.

Additional objects and advantages of the present invention will be apparent from the detailed description of preferred embodiments thereof, which proceeds with reference to the accompanying drawings.

BRIEF DESCRIPTION OF THE DRAWINGS

FIG. 2 is an enlarged fragmentary isometric view showing the layers of structural components forming the display panels described in the '149 Patent as viewed from the left side in FIG. 1.

FIG. 6 is an equivalent circuit showing for a display system the operation of the plasma as a switch for an exemplary row receiving a data strobe pulse and three exemplary data columns receiving a data drive signal.

FIGS. 9–14 are fragmentary, cross-sectional, partly schematic views of a selected channel showing electrical potentials applied to a reference electrode (anode), a row electrode (cathode), and a column electrode and certain charge distributions that exist within the selected channel.

FIG. 9 depicts the selected channel in an image field immediately after capture of a data signal of the same potential as a nominal electrical potential of the reference electrode (anode).

FIG. 10 depicts the selected channel in the image field immediately succeeding the field of FIG. 9 and before initiation of plasma discharge or data capture, with the application of a data signal of the same potential as the nominal electrical potential.

FIG. 11 depicts the selected channel in an image field immediately after capture of a data signal of lower potential than the nominal electrical potential.

FIG. 12 depicts the selected channel in the image field immediately succeeding the field of FIG. 11 and before initiation of plasma discharge or data capture, with the application of a data signal of higher potential than the nominal electrical potential.

FIG. 13 depicts the selected channel in an image field immediately after capture of a data signal of higher potential than the nominal electrical potential.

FIG. 14 depicts the selected channel in the image field immediately succeeding the field of FIG. 13 and before initiation of plasma discharge or data capture, with the application of a data signal of lower potential than the nominal electrical potential.

DETAILED DESCRIPTION OF PREFERRED EMBODIMENTS

The following discussion with reference to FIGS. 1–6 is based on the '149 Patent to provide background for the description of the present invention. The figure numbers used in the following discussion are the same as those of the present disclosure.

Figure 1:
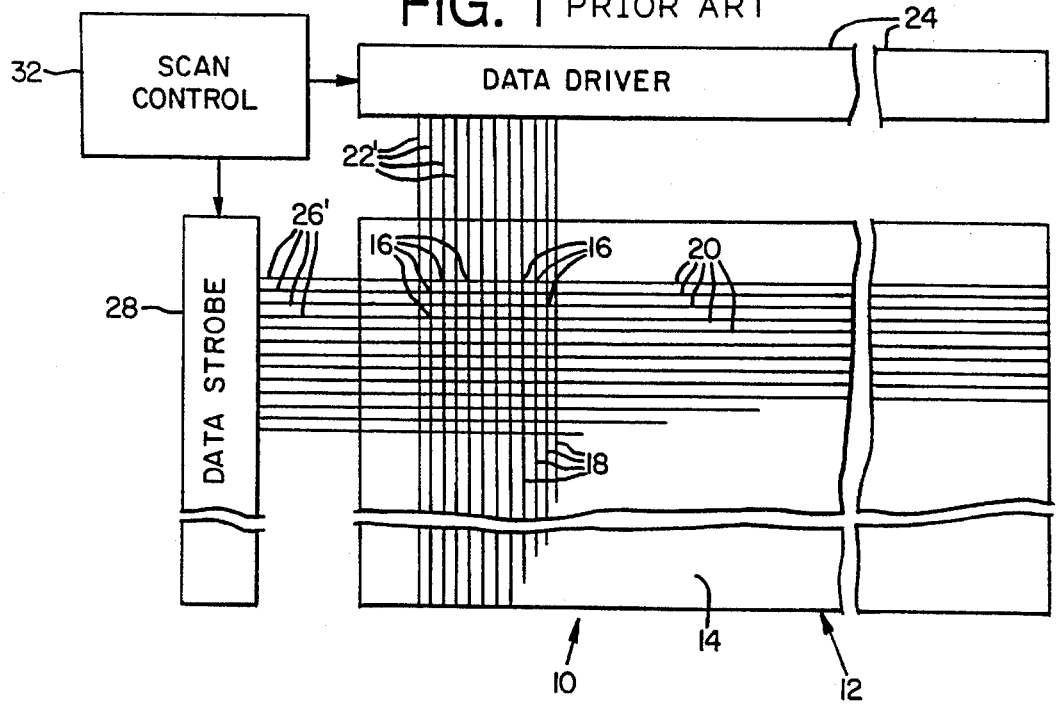
FIG. 1 PRIOR ART
FIG. 1 is a diagram showing a frontal view of the display surface of a display panel and associated drive circuitry of a display system described in the '149 Patent.

FIG. 1 shows a flat panel display system 10, which represents a first embodiment that implements the addressing structure and carries out the addressing method of the '149 Patent. With reference to FIG. 1, flat panel display system 10 comprises a display panel 12 having a display surface 14 that contains a pattern formed by a rectangular planar array of nominally identical data storage or display elements 16 mutually spaced apart by predetermined distances in the vertical and horizontal directions. Each display element 16 in the array represents the overlapping portions of thin, narrow electrodes 18 arranged in vertical columns and elongate, narrow channels 20 arranged in horizontal rows. (The electrodes 18 are hereinafter referred to as "column electrodes 18.") The display elements 16 in each of the rows of channels 20 represent one line of data.

The widths of column electrodes 18 and channels 20 determine the dimensions of display elements 16, which are of rectangular shape. Column electrodes 18 are deposited on a major surface of a first electrically nonconductive, optically transparent substrate, and channels 20 are inscribed in a major surface of a second electrically nonconductive, optically transparent substrate, as will be further described below. Skilled persons will appreciate that certain systems, such as a reflective display of either the direct view or projection type, would require that only one of the substrates be optically transparent.

Column electrodes 18 receive data drive signals of the analog voltage type developed on parallel output conductors 22' by different ones of the output amplifiers 22 (FIGS. 2–6) of a data driver or drive circuit 24, and channels 20 receive data strobe signals of the voltage pulse type developed on parallel output conductors 26' by different ones of the output amplifiers 26 (FIGS. 2–6) of a data strobe or strobe means or strobe circuit 28. Each of the channels 20 includes a reference electrode 30 (FIG. 2) to which a reference potential common to each channel 20 and data strobe 28 is applied.

To synthesize an image on the entire area of display surface 14, display system 10 employs a scan control circuit 32 that coordinates the functions of data driver 24 and data strobe 28 so that all columns of display elements 16 of display panel 12 are addressed row by row in row scan fashion. Display panel 12 may employ electro-optic materials of different types. For example, if it uses such a material that changes the polarization state of incident light rays 33, display panel 12 is positioned between a pair of light polarizing filters 34 and 36 (FIG. 2), which cooperate with display panel 12 to change the luminance of light propagating through them. The use of a scattering liquid crystal cell as the electro-optic material would not require the use of polarizing filters 34 and 36, however. A color filter (not shown) may be positioned within display panel 12 to develop multi-colored images of controllable color intensity. For a projection display, color can also be achieved by using three separate monochrome panels 10, each of which controls one primary color.

With reference to FIGS. 2–5, display panel 12 comprises an addressing structure that includes a pair of generally parallel electrode structures 40 and 42 spaced apart by a layer 44 of electro-optic material, such as a nematic liquid crystal, and a thin layer 46 of a dielectric material, such as glass, mica, or plastic. Electrode structure 40 comprises a glass dielectric substrate 48 that has deposited on its inner surface 50 column electrodes 18 of indium-tin oxide, which is optically transparent, to form a striped pattern. Adjacent pairs of column electrodes 18 are spaced apart a distance 52, which defines the horizontal space between next adjacent display elements 16 in a row.

Figure 3:
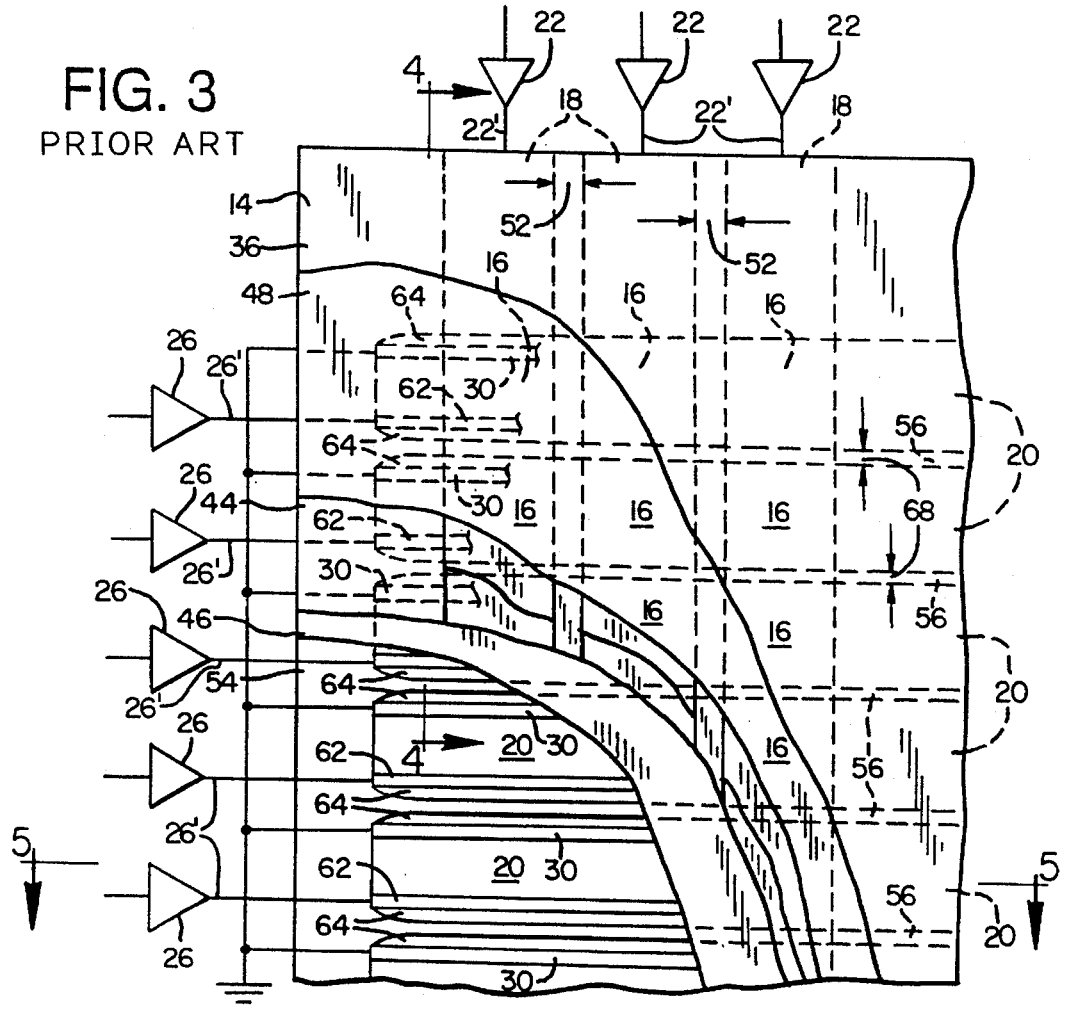
FIG. 3 PRIOR ART
FIG. 3 is an enlarged fragmentary frontal view with portions broken away to show different depthwise views of the interior of the display panel of FIG. 2.
Figure 5:
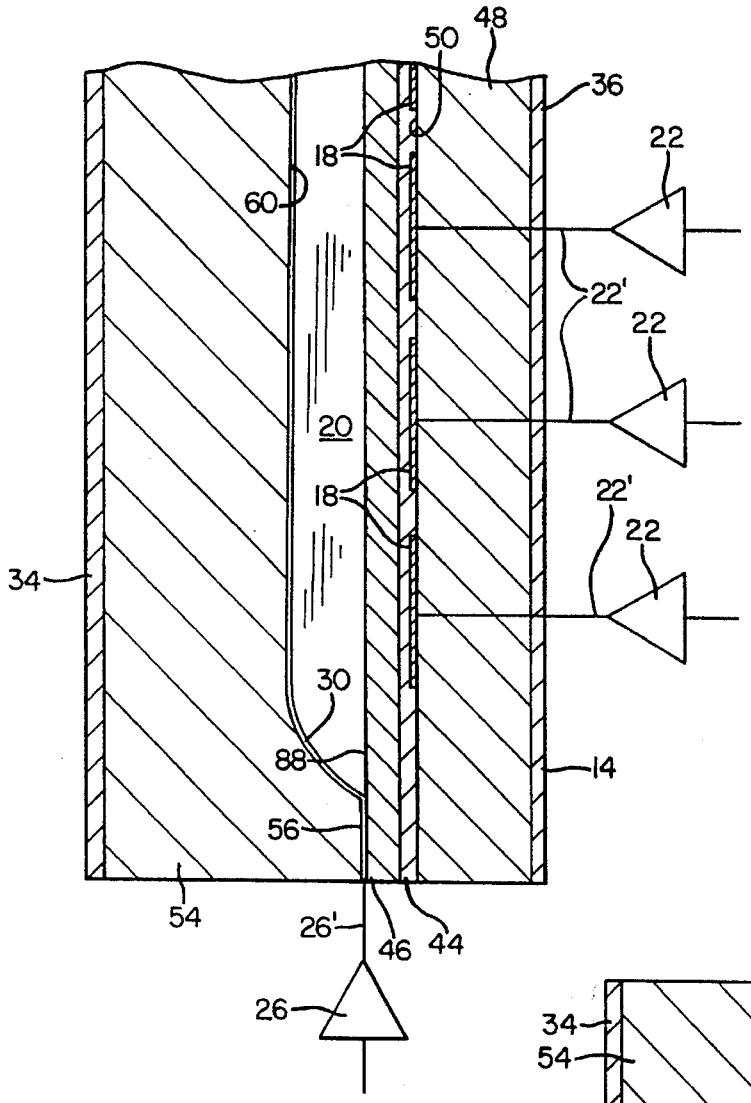
FIG. 5 PRIOR ART
FIG. 5 is an enlarged sectional view taken along lines 5—5 of FIG. 3.
Figure 4:
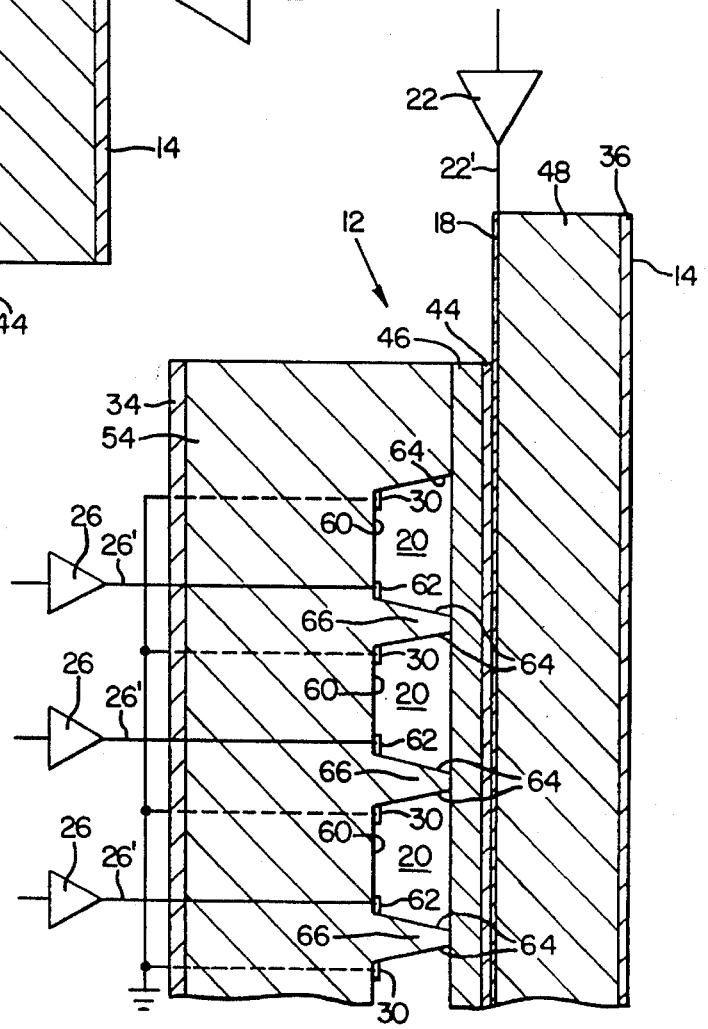
FIG. 4 PRIOR ART
FIG. 4 is an enlarged sectional view taken along lines 4—4 of FIG. 3.

Electrode structure 42 comprises a glass dielectric substrate 54 into whose inner surface 56 multiple channels 20 of trapezoidal cross section are inscribed. Channels 20 have a depth 58 measured from inner surface 56 to a base portion 60. Each one of the channels 20 has a pair of thin, narrow nickel electrodes 30 and 62 extending along base portion 60 and a pair of inner side walls 64 diverging in the direction away from base portion 60 toward inner surface 56. The reference electrodes 30 of the channels 20 are connected to a common electrical reference potential, which can be fixed at ground potential as shown. The electrodes 62 of the channels 20 are connected to different ones of the output amplifiers 26 (of which three and five are shown in FIG. 2 and FIG. 3, respectively) of data strobe 28. (The electrodes 62 are hereinafter referred to as "row electrodes 62.") To ensure proper operation of the addressing structure, the reference electrodes 30 and row electrodes 62 preferably are connected to the electrical reference potentials and the outputs 26' of data strobe 28, respectively, on opposite sides of display panel 10.

The sidewalls 64 between adjacent channels 20 define a plurality of support structures 66 whose top surfaces 56 support layer 46 of dielectric material. Adjacent ones of channels 20 are spaced apart by the width 68 of the top portion of each support structure 66, which width 68 defines the vertical space between next adjacent display elements 16 in a column. The overlapping regions 70 of column electrodes 18 and channels 20 define the dimensions of display elements 16, which are shown in dashed lines in FIGS. 2 and 3. FIG. 3 shows with better clarity the array of display elements 16 and the vertical and horizontal spacings between them.

Distance 52 is typically much less than the width of column electrodes 18. The inclinations of the side walls 64 between adjacent channels 20 specify the distance 68, which is typically much less than the width of channels 20. The widths of the column electrodes 18 and the channels 20 are a function of the desired image resolution, which is specified by the display application. It is desirable to make distances 52 and 68 as small as possible. In current models of display panel 12, the channel depth 58 is one-third the channel width.

Each of the channels 20 is filled with an ionizable gas, preferably one that includes helium, for reasons that will be explained below. Layer 46 of dielectric material functions as an isolating barrier between the ionizable gas contained within channel 20 and layer 44 of liquid crystal material. The absence of dielectric layer 46 would permit either the liquid crystal material to flow into the channel 20 or the ionizable gas to contaminate the liquid crystal material, however. Dielectric layer 46 may be eliminated from displays that employ a solid or encapsulated electro-optic material.

The principles underlying the operation of display panel 12 are that (1) each of its display elements 16 functions as a sampling capacitor for analog voltage data applied to the column electrode 18 forming a part of the display element and (2) the ionizable gas functions as a sampling switch. FIG. 6 is an equivalent circuit to which the following explanation of the operation of display system 10 refers.

With reference to FIG. 6, each of display elements 16 of display panel 12 can be modeled as a capacitor 80 (hereinafter "capacitor model 80"), whose top plate 82 represents one of the column electrodes 18 (FIG. 2) and whose bottom plate 86 represents the free surface 88 (FIG. 2) of layer 46 of the dielectric material. Capacitor model 80 represents the capacitive liquid crystal cell formed by an overlapping region of a column electrode 18 and a channel 20. The description herein of the operation of display system 10 refers to the capacitor model 80.

In accordance with the basic addressing procedure, data driver 24 captures a first line of data, which represents discrete samples of the time-varying voltage of analog data signal in a time interval of predetermined duration. The sample of the magnitude of the data signal at a particular instance within the time interval represents the magnitude of the analog voltage applied to a capacitor model 80 in a corresponding column position of the row electrode 62 receiving a strobe pulse. Data driver 24 develops on its output conductors 22 the analog voltages that are applied to column electrodes 18. In FIG. 6, four exemplary output amplifiers 22 of data driver 24 deliver analog voltages of positive polarity with respect to reference electrode 30 to the respective ones of column electrodes 18 to which they are connected. The application of a positive voltage on a column electrode 18 induces on free surface 88 (FIG. 2) of layer 46 of the dielectric material a voltage that is essentially equal to the magnitude of the applied voltage. This causes no change in the potential difference across capacitor model 80 and is represented in FIG. 6 by a top plate 82 and a bottom plate 86 with white (non-shaded) surfaces.

In this instance, the gas contained in a channel 20 is in a nonionized state, and the analog voltage developed on plates 82 and 86 of capacitor model 80 is positive with respect to the voltage potential of reference electrode 30 in the channel. Whenever data strobe 28 develops a negative-going voltage pulse of sufficient magnitude on the row electrode 62 positioned within a channel 20, the gas in the channel assumes an ionized state (i.e., becomes a plasma). The channel 20 whose row electrode receives the strobe pulse is represented in FIG. 6 in dark, thick lines. Under these conditions, the grounded reference electrode 30 and the strobed row electrode 62 function as an anode and a cathode, respectively, for the plasma contained within the channel.

The electrons in the plasma neutralize the induced positive voltage on the bottom plates 86 of capacitor models 80. The capacitor models 80 in the strobed row are charged with the data voltages applied across them. This condition is indicated in FIG. 6 by top plates 82 with white surfaces and bottom plates 86 with lined surfaces. Upon completion of the storage of the data voltages across capacitor models 80, data strobe 28 terminates the negative-going voltage pulse on the row electrode 62 of the strobed channel 20, thereby ending the strobe pulse and extinguishing the plasma.

Each of the row electrodes 62 is strobed in a similar manner until the entire display surface 14 is completely addressed and thereby stores an image field of data. The voltage remains stored across each of the capacitor models 80 in the strobed row for a time at least as long as the duration of the image field and is nearly independent of subsequent changes in data voltage applied to top plate 82 capacitor model 80. The voltage stored across each of the capacitor models 80 changes in accordance with the analog data voltages representing the display data of the next succeeding image field.

In a display system 10 whose image fields are in a noninterlaced format, the analog data voltages applied to column electrodes 18 in the next succeeding image field are of opposite polarity. Alternating between positive and negative polarities from one image field to the next image field provides a long term zero net DC voltage, which is typically required for long term operation of liquid crystal materials. The liquid crystal material produces the gray scale effect in response to the root-mean-square (rms) value of the applied analog voltage data. The display image produced is, therefore, unaffected by alternate changes in polarity of the analog voltage data.

In a display system 10 whose image fields are in an interlaced format, the analog data voltages applied to column electrodes 18 in next succeeding image frames are of opposite polarity to achieve the long term zero net DC voltage. Each image frame includes two image fields of which each comprises one-half the number of addressable lines.

The description presented above indicates that the ionizable gas contained within each of the channels 20 operates as an electrical switch 90 whose contact position changes between conducting and nonconducting states as a function of the voltage applied by data strobe 28. The switches 90 shown in FIG. 6 in the open position are connected to reference electrodes 30 and are driven by a strobe pulse applied to row electrodes 62. The absence of a strobe pulse allows the gas within the channels 20 to be in a nonionized state and thereby be in a nonconducting state. The switches 90 shown in FIG. 6 in the closed position are connected to a reference electrode 30 and are driven by a strobe pulse that is applied to row electrode 64 and is of a magnitude that causes the gas within the channel 20 to be in an ionized state and thereby be in a conducting state. In FIG. 6, the amplifier 26 shown in the middle of the three output amplifiers 26 of data strobe 28 strobes a row of capacitor models 80 to establish and store the display data voltages across them.

To function as a switch, the ionizable gas contained within channels 20 beneath electrode structure 40 communicates with layer 46 of the dielectric material to provide an electrically conductive path from layer 46 of the dielectric material to reference electrode 30. The plasma in a channel 20 whose row electrode 62 receives a strobe pulse provides a ground path to the capacitor model 80 representing the portion of liquid crystal material positioned adjacent the plasma. This allows the capacitor models 80 to sample the analog data voltages applied to column electrodes 18. Extinguishing the plasma acts to remove the conducting path, thereby allowing the data sample to be held across the display element. The voltages remain stored across layer 44 of the liquid crystal material until voltages representing a new line of data in a subsequent image field are developed across the layer 44. The above-described addressing structure and technique provide signals of essentially 100% duty cycle to every one of the display elements 16.

Figure 7:
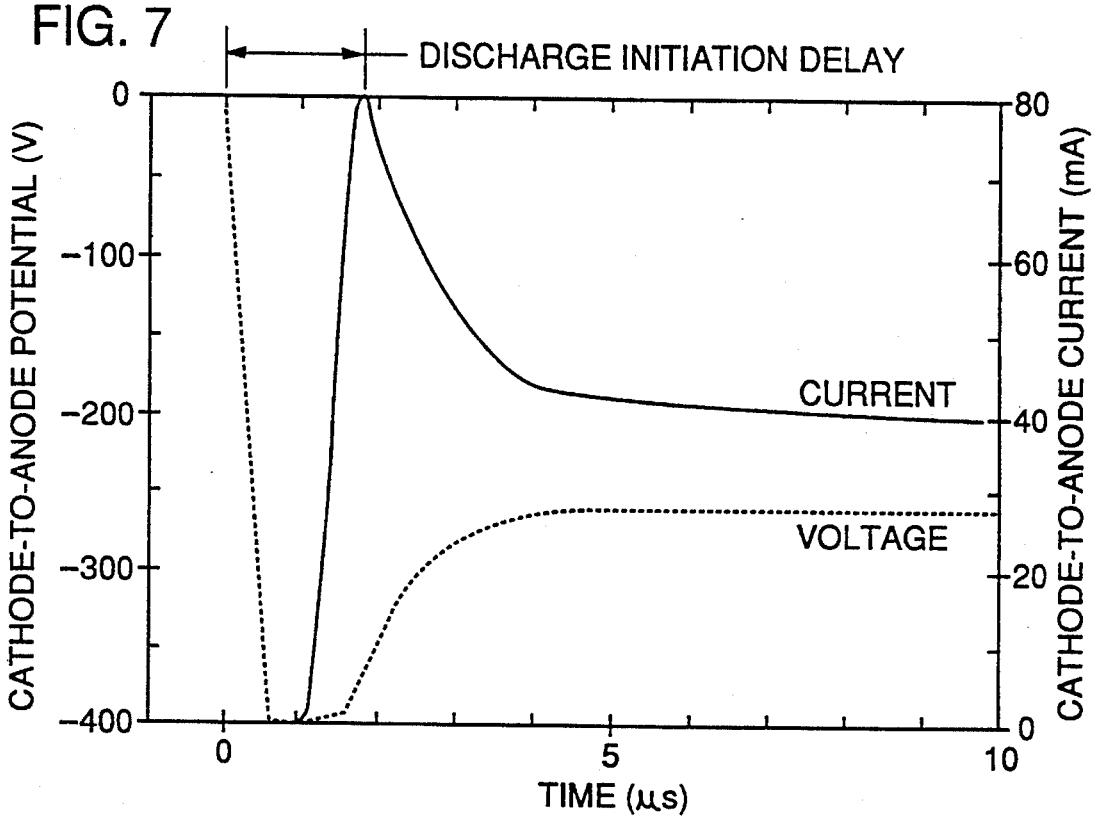
FIG. 7 is a graph of illustrative row electrode (cathode)-to-reference electrode (anode) potential and current as a function of time after initiation of an ionizing signal.
Figure 8:
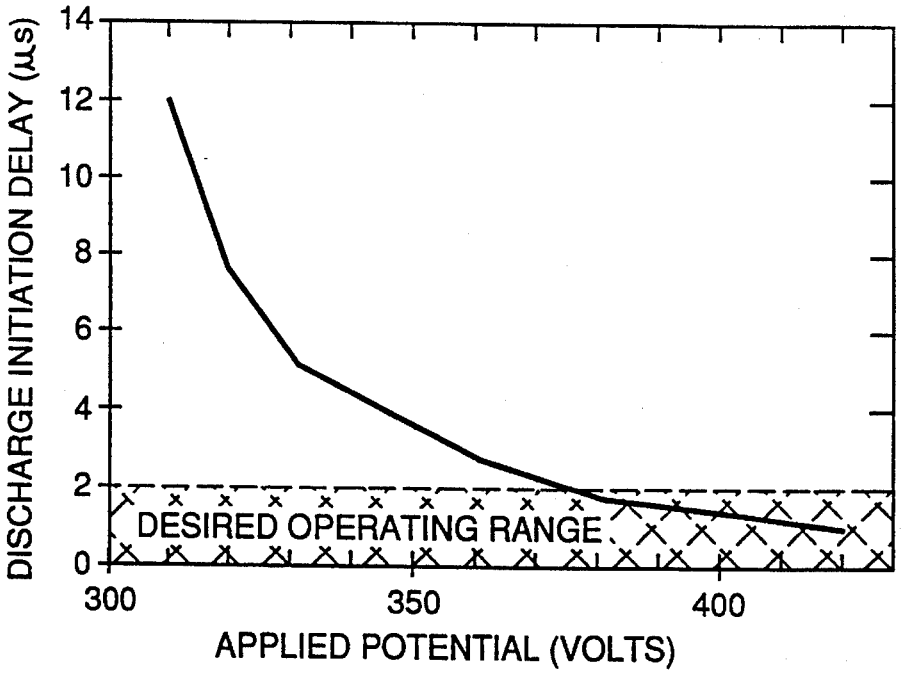
FIG. 8 is a graph of illustrative discharge initiation delays as a function of the potential applied between row electrode (cathode) and reference electrode (anode).
Figure 15:
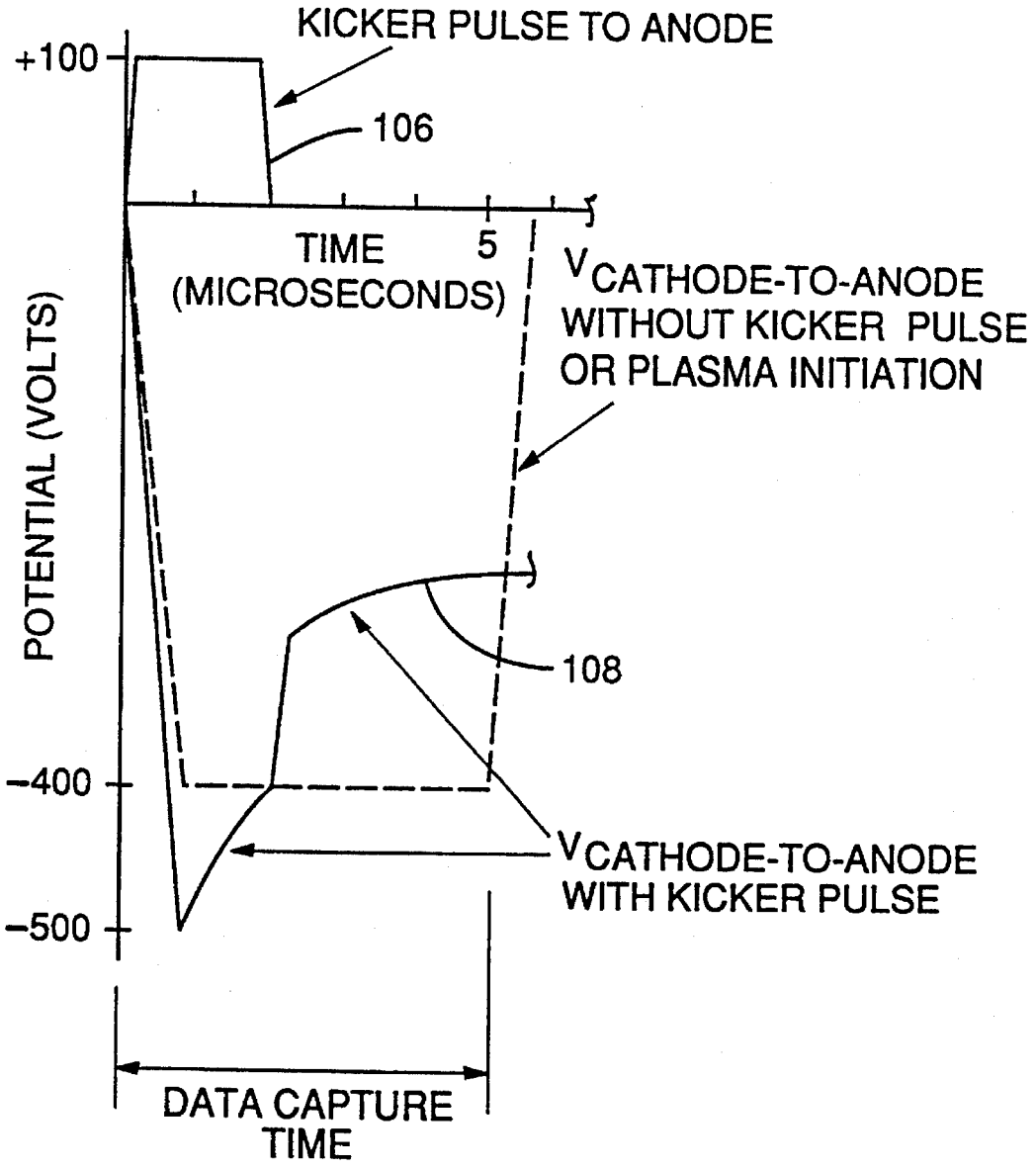
FIG. 15 is a graph of illustrative row electrode (cathode)-to-reference electrode (anode) potential as a function of time after introduction of an ionizing signal when an ionizing signal is applied without producing ionization and also when a kicker pulse in accordance with the invention is applied so as to produce ionization.

Each of FIGS. 7–8 refers to a selected channel 20' (FIGS. 9–14) in a flat panel display system of the type described in connection with FIGS. 1–6. Channel 20' has an approximately flattened-hemispherical cross-section that is the practical outcome of attempting to produce with conventional photopatterning and etching techniques the more preferred trapezoidal cross-section of channel 20 shown in FIGS. 1–6. As shown in FIGS. 9–14, channel 20' is formed in a lower electrode structure 42' and a dielectric 54' and contains a reference electrode 30' and a row electrode 62'. The preceding discussion with respect to channel 20, reference electrode 30, lower electrode structure 42, dielectric 54, base portion 60, and row electrode 62 applies to corresponding components with identical reference numerals followed by primes. When electro-optic material 44 is a liquid crystal, dielectric layer 46 is preferably separated from inner surface 50 of electrode structure 40 as described in U.S. patent application Ser. No. 08/026,394 for SPACERS FOR USE IN AN ELECTRO-OPTICAL ADDRESSING STRUCTURE, filed concurrently herewith and assigned to the assignee of the present application. In each of FIGS. 7–8 channel 20' contained helium at a pressure of 280 millibars, reference electrode 30' and row electrode 62' had chromium surfaces, were each 75 microns (0.003 inch) wide and 2 microns (approximately 0.0001 inch) thick, and were spaced apart 200 microns (0.008 inch), the channel depth was 150 microns (0.006 inch), the channel had a top width of 450 microns (0.018 inch), the channel-to-channel spacing was approximately 508 microns (0.02 inch), and the length of an active portion (i.e., the portion below data electrodes 18) of the channel was approximately 3.5 inches. Exemplary values of certain parameters taken from FIGS. 7–8 are set forth in parentheses in the discussion below. FIG. 15 qualitatively indicates the response of such a system to the combined application of the second electrical signal or strobe pulse or ionizing signal with a kicker pulse.

FIG. 7 is a graph of illustrative potential and current between row electrode (cathode) 62' and reference electrode (anode) 30' as a function of time after initiation of a second signal or strobe pulse or ionizing signal to channel 20'. Shortly after the potential of row electrode 62' with respect to reference electrode 30' reaches a maximum amplitude (−400 volts), the gaseous medium in channel 20' is ionized and the current between row electrode 62' and reference electrode 30' rises rapidly to a peak maximum value (80 milliamperes). The time interval between initiation of an ionizing signal and maximum current between row electrode 62' and reference electrode 30' defines a discharge initiation delay for channel 20'. A current limiting circuit (not shown) is provided to limit current between row electrode 62' and reference electrode 30' to a predetermined level. After the current limiting circuit becomes fully effective (after 5 microseconds), the current from row electrode 62' to reference electrode 30' is limited (to 40 milliamperes in this example) and the potential difference between reference electrode 30' to row electrode 62' is reduced (to −270 volts in this example) to maintain that current; current and voltage so limited are maintained for a time long enough to establish the desired electric field across electro-optic material 44 so as to stabilize its capture of the data signal on column electrode 18. The potential of row electrode 62' is returned to the potential of reference electrode 30' when electrical discharge in channel 20' is no longer needed (not shown in FIGS. 7 or 15).

FIG. 8 is a graph of illustrative discharge initiation delays as a function of the potential applied between reference electrode (anode) 30' and row electrode (cathode) 62'; the higher the applied potential, the shorter the discharge initiation delay. For a flat panel display 10 intended to operate at video rates, typically 60 image fields per second, a desired operating range of discharge initiation delay time is 0–2 microseconds. For the specific example of FIG. 8, achieving a discharge initiation delay in that range requires that a potential of approximately 370 volts or greater be applied between row electrode 62' and reference electrode 30'. If the potential from row electrode 62' to reference electrode 30' has a magnitude of less than approximately 370 volts, the discharge initiation delay rises rapidly to levels unacceptable for video rate applications.

Charge distributions induced by data signals applied to column electrodes 18 on free surface 88 associated with display element 16 affect the electric field experienced by the ionizable gaseous medium between row electrode 62' and reference electrode 30'. As a result, application of the same ionizing signal to row electrode 62' for each charge distribution resulting from signals on column electrodes 18 can produce different discharge initiation delays (FIGS. 7–8). This problem is particularly acute when, as explained above, the signals on column electrodes 18 alternate in polarity with respect to the nominal electrical potential of reference electrode 30' in channel 20'.

FIGS. 9–14 are fragmentary, cross-sectional, partly schematic views of a selected plasma discharge channel 20' showing electrical potentials applied to reference electrode 30', row electrode 62', and column electrode 18 and certain charge distributions that exist on surface 88. Each of FIGS. 10, 12, and 14 shows only a particular time in the operation of channel 20'; as discussed above, the potential and current between reference electrode 30' and row electrode 62' follow the pattern discussed above in connection with FIG. 7 during the time channel 20' is addressed in an image field, which ends with bringing the potential and current between reference electrode 30' and row electrode 62' to zero, as shown in FIGS. 9, 11, and 13.

In each of FIGS. 9–14 reference electrode 30' is connected to an amplifier 100, which holds reference electrode 30' at a nominal electrical potential (except when providing a kicker pulse as described below in connection with FIGS. 14–15) that serves as a reference potential for electrical signals on column electrode 18 and row electrode 62'.

The nominal electrical potential is considered herein as constant and as zero volts during an image field even though it may vary from one image field to a succeeding image field. In one example, output amplifiers 22 for column electrodes 18 are more economically provided with an ability to provide data signals in an amplitude range (e.g., 50 volts) rather than with an ability to provide data signals between the amplitude range above a reference (e.g., 0 to +50 volts) and the amplitude range below a reference (e.g., 0 to −50 volts). To use more economical output amplifiers 22 in a drive system having alternating polarity of the type discussed above, the electrical potential of reference electrodes 30' is 0 volts for an image field in which column electrodes 18 are driven to a higher potential than reference electrode 30' and +50 volts for an image field in which column electrodes 18 are driven to a lower potential than reference electrode 30'. In the former image field a data signal at 0 volts produces an OFF storage element state and a data signal at +50 volts produces an ON storage element state. In the latter image field a data signal at 50 volts produces an OFF storage element state and a data signal at 0 volts produces an ON storage element state. For simplicity, the discussion herein proceeds with reference only to the nominal electrical potential—taken as 0 volts—of reference electrode 30' within each image field.

A variety of factors, such as stray capacitance that causes cross-talk, may tend to cause the electrical potential stored across layers 44 and 46 of a pixel to depart from a constant value during an image field. Such factors are preferably reduced or eliminated; therefore, the discussion herein proceeds on the basis that stored electrical potential is essentially constant during an image field.

With reference to FIG. 9, a circuit means or amplifier 100 controls the electrical potential of reference electrode 30' which is not connected directly to local ground as was reference electrode 30 of FIGS. 1–6. Amplifier 100 may set the electrical potential of reference electrode 30' at local ground or deliver a kicker pulse as will be described below in connection with FIGS. 14–15. When amplifier 100 is not delivering a kicker pulse, it holds reference electrode 30' at the nominal electrical potential, to which other potentials referred to herein are referenced.

To achieve a net zero long-term DC voltage across liquid crystal material 44 the data signals on column electrodes 18 alternate in polarity in succeeding image fields with respect to the nominal electrical potential. The data signal provides for each data storage or display element 16 one of OFF and ON storage element states (hereinafter "ON state" and "OFF state") of the type described above. Preferably, the OFF and ON states represent, respectively, the absence and presence of an electric field across liquid crystal material 44. As an example, the OFF and ON states correspond, respectively, to a lightest pixel and a darkest pixel or a gray-scale pixel in a displayed image.

Amplifier 100 provides electrical signals which provide the OFF state and at least one preselected ON state to display element 16. These electrical signals are preferably in accordance with the system described above and provided before ionization of the gaseous medium in the channel 20' which in part defines display element 16.

FIG. 9 depicts channel 20' in an image field N after capture of a data signal having the same potential as the nominal electrical potential, i.e., a data signal that is an OFF signal. Surface 88 carries no charge because there was no electrical potential difference between column electrode 18 and reference electrode 30' and because the potential of row electrode 62' is returned to the nominal electrical potential after a data capture time but before the end of field N. After data capture channel 20' becomes free of electric fields as a result of ionization of the gaseous medium in channel 20' and redistribution of charge among surfaces exposed to channel 20' by ions and electrons in the gaseous medium that remain after the discharge is extinguished and by ions and/or electrons produced by neutral, metastable atoms and/or molecules ("metastables") (preferably atoms, more preferably noble gas atoms, and more preferably helium atoms) that remain after the discharge is extinguished in the gaseous medium. Metastables have an electron in an excited state from which the electron cannot transition to a state of lower energy by emitting electromagnetic radiation (e.g., the 19.6 electron volt metastable state of helium). As a result, metastables typically have a relatively long decay time in physical systems. Metastables are thus a reservoir of potential energy for producing ions and electrons through processes such as collisions.

FIG. 10 depicts channel 20' of FIG. 9 in the image field N+1 immediately succeeding image field N of FIG. 9 after a second electrical signal (cathode bias) is applied to row electrode 62' but before plasma initiation. Amplifier 22 provides to column electrode 18 an OFF signal; the second electrical signal drives row electrode 62' to a lower potential than the nominal electrical potential; and amplifier 100 holds reference electrode 30' at the nominal electrical potential. The gaseous medium in channel 20' thus experiences a full and undistorted potential difference (e.g., –400 volts) from reference electrode 30' to row electrode 62'; as indicated in FIG. 8, this produces a discharge initiation delay in the desired operating range. Successive image fields in both of which display element 16 experiences a data signal that is an OFF signal thus present no difficulty in having the ionization initiate within the required time if the second electrical signal applied to row electrode 62' has appropriate amplitude with respect to the nominal potential.

FIG. 11 depicts selected channel 20' in an image field N after capture of a data signal that is an ON signal of lower potential than the nominal electrical potential (e.g., –50 volts). Row electrode 62' is returned to the nominal electrical potential when the ionization ends and the potentials on the data electrodes are held constant until the ions and metastables from the ionization have decayed. Reference electrode 30' is held at the nominal electrical potential. Surface 88 carries a positive charge 102 as a result of ionization of the gaseous medium in channel 20' in field N and redistribution of charge among surfaces exposed to channel 20' by electrons or ions in the gaseous medium. The net effect of the redistribution of charge is to make the interior of channel 20' free of electric fields.

FIG. 12 depicts selected channel 20' in the image field N+1 immediately succeeding image field N shown in FIG. 11 after the second electrical signal is applied to row electrode 62' but before plasma initiation. Amplifier 22 provides to column electrode 18 an ON signal of higher potential than the nominal electrical potential (e.g., +50 volts); the second electrical signal drives row electrode 62' to a lower potential than the nominal electrical potential (e.g., –400 volts); and amplifier 100 holds reference electrode 30' at the nominal electrical potential. The gaseous medium in channel 20' thus experiences an electrical potential difference across paths running directly from surface 88 to row electrode 62' that is greater than the potential difference from reference electrode 30' to row electrode 62' because surface 88 is at a potential higher than the nominal electrical potential. Positive electrical charge 102 thus affects the electric fields in the gaseous medium in channel 20' to make ionization of the gaseous medium easier in the condition shown in FIG. 12 than in the condition shown in FIG. 10. Given that the electrical potential across the gaseous medium exceeds the potential difference between reference electrode 30' and row electrode 62' the condition shown in FIG. 12 produces an even smaller discharge initiation delay (FIG. 8) than the condition shown in FIG. 10. Thus, when an image field N+1 in which data signals that are ON signals of higher potential immediately follows an image field N in which data signals are ON signals of lower potential, ionization occurs more readily than when a field with data signals that are OFF signals immediately follows a field also with data signals that are OFF signals.

Such favorable results are not always achieved, as shown in FIGS. 13–14. FIG. 13 depicts selected channel 20' in an image field N after capture of a data signal that is an ON signal of higher potential (e.g., +50 volts). Row electrode 62' is returned to the nominal electrical potential when the ionization ends, and the potentials on the data electrodes are held constant until the ions and metastables from the ionization have decayed. Reference electrode 30' is held at the nominal electrical potential. Surface 88 carries a negative electrical charge 104 as a result of ionization of the gaseous medium in channel 20' in field N, the provision of an ON signal of higher potential on column electrode 18, and redistribution of charge as described in connection with FIG. 11 that makes the interior of channel 20' free of electric fields.

FIG. 14 depicts selected channel 20' in the image field N+1 immediately succeeding image field N shown in FIG. 13 after the second electrical signal is applied to row electrode 62' but before plasma initiation. Amplifier 22 provides to column electrode 18 a data signal that is an ON signal of lower potential than the nominal electrical potential (e.g., –50 volts); the second electrical signal drives row electrode 62' to a lower potential than the nominal electrical potential (e.g., –400 volts). If amplifier 100 were to hold reference electrode 30' at the nominal electrical potential (a condition not shown in FIG. 14), as shown in FIGS. 10 and 12, electric fields in channel 20' would interfere with ready ionization of the gaseous medium in channel 20'. It appears that in such a case negative electrical charge 104 and the ON signal of lower potential on column electrode 18 compress or "pinch" electric field lines in channel 20' toward bottom surface 60' so as to tend to prevent or to retard incipient ionization of the gaseous medium in channel 20'. Negative electrical charge 104 thus makes ionization of the gaseous medium more difficult in the condition shown in FIG. 14 than in the condition shown in FIG. 10 and much more difficult than in the condition shown in FIG. 12. This produces a discharge initiation delay (FIG. 8) greater than the discharge initiation delay of the condition shown in FIG. 10.

The invention solves this problem by providing at the output of amplifier 100 a third electrical signal or kicker pulse at a time coincident to the application of the second or bias signal to row electrode 62'; the kicker pulse cooperates with the bias signal to cause ionization of the gaseous medium in channel 20' within a predetermined discharge initiation delay time tolerance (for example, as shown in FIG. 8, within 2 microseconds). The kicker pulse may achieve this result by increasing the potential difference between reference electrode 30' and row electrode 62'. The kicker pulse may be provided to reference electrode 30' (for example, a pulse of +100 volts) or to row electrode 62' (for example, not shown, a pulse of an additional –100 volts), or it may provide multiple signals provided to both reference electrode 30' and row electrode 62' (for example, not shown, a pulse of 50 volts to reference electrode 30' and an additional pulse of –50 volts to row electrode 62'). Preferably the kicker pulse does not substantially change or adversely affect the response of liquid crystal material 44 to the bias signal applied to row electrode 62' or to the data signal applied to column electrode 18.

The character of the kicker pulse depends on the depth of channel 20' and the relative placement in the channel of reference electrode 30' and row electrode 62', which affect the extent to which charge on surface 88 or a signal on column electrode 18 influences the electric field in channel 20' when the bias voltage is provided to row electrode 62'. The character of the kicker pulse also depends on the material used as electro-optic material 44 and on a variety of factors specific to materials exposed to channel 20', including the emissivity of the exposed surfaces of reference electrode 30' and row electrode 62'. The kicker pulse also is preferably of a character which creates a total effect from all types of cross-talk falling within an acceptable range. Less preferably, the kicker pulse is of a character that allows mitigation of any cross-talk effects such as in the ways described in the copending applications.

The condition in which ionization is most difficult is that shown in FIG. 14 when an ON signal of higher potential in image field N and an ON signal of lower potential in image field N+1 are the ON signals of greatest amplitude (e.g., an amplitude of 50 volts that is the highest amplitude among data signals). Between such a condition and the neutral condition shown in FIG. 10 there is a range of intermediate conditions in which ionization is more likely than in the condition shown in FIG. 14 but less likely than in the condition shown in FIG. 10. Those conditions include (1) an ON signal of higher potential in an image field N followed by an OFF signal in the immediately succeeding image field N+1, (2) an OFF signal in an image field N followed by an ON signal of lower potential in the immediately succeeding image field N+1, and (3) many combinations involving gray scale ON signals similar to the conditions shown in FIG. 14 and to the preceding conditions (1) and (2). It appears that any ranking of such other conditions by difficulty of initiating plasma discharge depends on the factors mentioned above that influence the selection of a kicker pulse. If discharge initiation delay problems are encountered with such intermediate conditions, they can be cured by applying a kicker pulse of a character adequate to cure such problems for the ON signal of greatest amplitude, as shown in FIG. 14.

Amplifier 100 may provide the kicker pulse at a wide variety of alternative times differing primarily in the frequency with which the kicker pulse is applied and in the complexity of circuitry required to deliver the kicker pulse. Amplifier 100 applies the kicker pulse (1) to any specific channel in an image field in which, for at least one data storage element defined in part by the specific channel, the first electrical signal is an ON signal of lower potential and was, in the immediately preceding image field, an ON signal of higher potential; (2) to any specific channel in an image field in which, for at least one data storage element defined in part by the specific channel, the first electrical signal is an ON signal of lower potential; (3) to any specific channel in an image field in which, for at least one data storage element defined in part by the specific channel, the first electrical signal in the immediately preceding image field was an ON signal of higher potential; (4) to substantially all channels in any image field in which any of the first electrical signals is an ON signal of lower potential; (5) to substantially all channels in any image field in which, for at least one data storage element defined in part by the specific channel, the first electrical signal in the immediately preceding image field was an ON signal of higher potential; or (6) to substantially all channels in substantially all image fields which do not immediately succeed an image field in which any of the first electrical signals is an ON signal of lower potential. Finally, in an extensive application of the kicker pulse, amplifier 100 provides the kicker pulse to substantially all channels in substantially all image fields.

Skilled persons can readily choose among these options for delivering the kicker pulse by considering such factors as the desired frequency of application of the kicker pulse, the acceptable predetermined discharge initiation delay time tolerance, the factors mentioned above that affect the choice of kicker pulse, and the form of the second electrical signals or bias signals to be applied to row electrode 62'.

Where it is acceptable to provide the kicker pulse to every channel in every image field, it may also be acceptable to connect multiple channels (for example 40 channels in an electro-optic display having 480 channels) to one amplifier 100 and to provide from that amplifier a kicker pulse whenever any one channel connected to the amplifier is to receive a kicker pulse. This alternative can greatly reduce the number of amplifiers; it has the disadvantage of providing a kicker pulse to channels connected to amplifier 100 that are not to be ionized and thus to which no ionizing signal is provided between reference electrode 30' and row electrode 62'.

FIG. 15 qualitatively graphically indicates the potential between reference electrode (anode) 30' and row electrode (cathode) 62' as a function of time after introduction of the second signal or strobe pulse or ionizing signal in channel 20' of the display of FIGS. 7–8. The dashed lines in FIG. 15 show an example of the voltage waveform of the ionizing signal when the gaseous medium in channel 20' does not ionize on application of the ionizing signal; such a failure to ionize can occur in conditions such as shown in FIGS. 13–14 if no kicker pulse is applied. Solid line 106 of FIG. 15 shows an example of a kicker pulse 106 provided to reference electrode 30'. Kicker pulse 106 is approximately +100 volts with respect to the nominal electrical potential and lasts approximately 2 microseconds. Kicker pulse 106 cooperates with the ionizing signal to cause ionization of the gaseous medium in channel 20'; solid line 108 shows the resulting electrical potential between row electrode 62' and reference electrode 30'.

The data capture time is a time adequate to ensure that the signals on column electrodes 18 become fully expressed across electro-optic layer 44 and dielectric layer 46. Although shown in FIG. 15 as approximately 5 microseconds, the actual time that the ionization must persist to ensure that enough ions, electrons, and metastables are generated to ensure correct data capture may be shorter, possibly less than a microsecond. The data capture time is shown in FIG. 15 as approximately the time needed after initiation of ionization for current-limiting circuits to stabilize the potential and current between reference electrode 30' and row electrode 62'. It is not necessarily the time the ionization must persist to ensure that enough ions, electrons, and metastables are generated to ensure correct data capture.

It will be apparent to skilled persons that many changes may be made to details of the specific embodiments of the invention described herein without departing from the underlying principles thereof. The scope of the invention should, therefore, be determined only by the following claims.

We claim:

1. An addressable electro-optic system having multiple light pattern data storage elements, comprising:

a first substrate supporting on a major surface thereof plural nonoverlapping first electrodes that extend in a first direction;

a second substrate having plural nonintersecting channels that extend along a major surface thereof in a second direction, each of the channels containing an ionizable gaseous medium and having one of plural second electrodes and one of plural reference electrodes extending along a substantial portion of the length of the channel;

the first and second substrates being disposed face-to-face and spaced-apart with the first direction transverse to the second direction to define overlapping regions of the first electrodes and the channels;

a layer of electro-optic material having optical properties responsive to a difference in voltage across it positioned between the first and second substrates, the layer of electro-optic material and the overlapping regions defining plural light pattern data storage elements that selectively store an image field representing typically nonuniform light pattern information carded by the first electrodes;

first means for providing first electrical signals to the first electrodes and second means for providing second electrical signals to the second electrodes, the first and second means providing in each of successive image fields the coincident application of respective first and second electrical signals to each of the storage elements to effect ionization of the gas associated with the storage elements and to change in response to the first electrical signal the electro-optical properties of the regions of the layer associated with the storage elements; and third means for providing to the reference electrode positioned in a selected one of the channels a third electrical signal at a time coincident to the application of the second electrical signal to the second electrode positioned in the selected channel, the third electrical signal cooperating with the second electrical signal to cause ionization of the gaseous medium in the selected channel within a predetermined discharge initiation delay time tolerance.

2. The addressable electro-optic system of claim 1, wherein the third electrical signal increases the electrical potential difference between the second and reference electrodes.

3. The addressable electro-optic system of claim 1, wherein the third electrical signal does not substantially change the response of the electro-optic material to the first and second signals during a predetermined data capture time.

4. The addressable electro-optic system of claim 1, wherein the third means applies multiple third electrical signals to the reference electrode.

5. The addressable electro-optic system of claim 1, wherein the electro-optic material is of the RMS-responding type and the third signal is of a character insufficient to affect substantially the RMS field applied to the electro-optic material during a succession of image fields.

6. The addressable electro-optic system of claim 1, wherein the electro-optic material comprises a nematic liquid crystal material.

7. The addressable electro-optic system of claim 6, wherein the second substrate includes plural support structures defining the channels, and further comprising a layer of a dielectric material disposed between the first and second substrates, separating the liquid crystal material from the ionizable gaseous medium, and cooperating with the support structures to separate the ionizable gaseous medium in adjacent channels.

8. The addressable electro-optic system of claim 1, wherein the electro-optic layer has optical properties responsive to a difference in voltage stored across it.

9. An addressable electro-optic system having multiple light pattern data storage elements, comprising:

a first substrate supporting on a major surface thereof plural nonoverlapping first electrodes that extend in a first direction;

a second substrate having plural nonintersecting channels that extend along a major surface thereof in a second direction, each of the channels containing an ionizable gaseous medium and having one of plural second electrodes and one of plural reference electrodes extending along a substantial portion of the length of the channel;

the first and second substrates being disposed face-to-face and spaced-apart with the first direction transverse to the second direction to define overlapping regions of the first electrodes and the channels;

a layer of material having electro-optic properties positioned between the first and second substrates, the layer of electro-optic material and the overlapping regions defining plural light pattern data storage elements that selectively store an image field representing typically nonuniform light pattern information carried by the first electrodes;

first means for providing first electrical signals to the first electrodes and second means for providing second electrical signals to the second electrodes, the first and second means providing in each of successive image fields the coincident application of respective first and second electrical signals to each of the storage elements to effect ionization of the gas associated with the storage elements and to change in response to the first electrical signal the electro-optical properties of the regions of the layer associated with the storage elements, the selected reference electrode having a nominal electrical potential, the first means further for providing the first electrical signals in one of an OFF storage element state and a preselected ON storage element state, the first electrical signals including an OFF signal, an ON signal of higher potential, and an ON signal of lower potential, the OFF signal providing storage elements in the OFF storage element state, the ON signals of higher and lower potential providing storage elements in the preselected ON storage clement state, the ON signal of higher potential placing first electrodes at a potential higher than the nominal electrical potential, the ON signal of lower potential placing first electrodes at a potential lower than the nominal electrical potential, the second electrical signal placing the selected second electrode at lower potential than the nominal electrical potential to produce ionization in the channel, the first electrodes not receiving an ON signal of higher potential in an image field immediately succeeding an image field in which the first electrodes received an ON signal of higher potential, and the first electrodes not receiving an ON signal of lower potential in an image field immediately succeeding an image field in which the first electrodes received an ON signal of lower potential; and third means for providing to the reference electrode positioned in a selected one of the channels a third electrical signal at a time coincident to the application of the second electrical signal to the second electrode positioned in the selected channel, the third electrical signal cooperating with the second electrical signal to cause ionization of the gaseous medium in the selected channel within a predetermined discharge initiation delay time tolerance.

10. The addressable electro-optic system of claim 9, wherein the third electrical signal is applied to any specific channel in an image field in which, for at least one data storage element defined in part by the specific channel, the first electrical signal is an ON signal of lower potential and was, in the immediately preceding image field, an ON signal of higher potential.

11. The addressable electro-optic system of claim 9, wherein the third electrical signal is applied to any specific channel in an image field in which, for at least one data storage element defined in part by the specific channel, the first electrical signal is an ON signal of lower potential.

12. The addressable electro-optic system of claim 9, wherein the third electrical signal is applied to any specific channel in an image field in which, for at least one data storage element defined in part by the specific channel, the first electrical signal in the immediately preceding image field was an ON signal of higher potential.

13. The addressable electro-optic system of claim 9, wherein the third electrical signal is applied to substantially all channels in any image field in which any of the first electrical signals is an ON signal of lower potential.

14. The addressable electro-optic system of claim 9, wherein the third electrical signal is applied to substantially all channels in any image field in which, for at least one data storage element defined in part by the specific channel, the first electrical signal in the immediately preceding image field was an ON signal of higher potential.

15. The addressable electro-optic system of claim 9, wherein the third electrical signal is applied to substantially all channels in substantially all image fields which do not immediately succeed an image field in which any of the first electrical signals is an ON signal of lower potential.

16. The addressable electro-optic system of claim 9, wherein the third electrical signal is applied to substantially all channels in substantially all image fields.

17. The addressable electro-optic system of claim 9, wherein the OFF signal is at the nominal electrical potential.

18. The addressable electro-optic system of claim 9, wherein the electro-optic layer has optical properties responsive to a difference in voltage across it.

19. The addressable electro-optic system of claim 9, wherein the electro-optic layer has optical properties responsive to a difference in voltage stored across it.

* * * * *

UNITED STATES PATENT AND TRADEMARK OFFICE
CERTIFICATE OF CORRECTION

PATENT NO. : 5,623,276

DATED : April 22, 1997

INVENTOR(S) : JOHN S. MOORE and KEVIN J. ILCISIN

It is certified that error appears in the above-identified patent and that said Letters Patent is hereby corrected as shown below:

Col. 15, claim 1, line 24, "carded" should be "carried."

Signed and Sealed this

Eighth Day of December, 1998

*Attest:*

*Attesting Officer*

BRUCE LEHMAN

*Commissioner of Patents and Trademarks*